United States Patent [19]

Matsuura

[11] 4,029,218

[45] June 14, 1977

[54] TWO-STORIED PARKING APPARATUS FOR AUTOMOBILES

[76] Inventor: Takashi Matsuura, 28-4, Izumi 2-chome, Suginami, Tokyo, Japan

[22] Filed: Feb. 21, 1975

[21] Appl. No.: 551,770

[52] U.S. Cl. ..... 214/16.1 R; 187/8.41

[51] Int. Cl.[2] ..... E04H 6/06

[58] Field of Search ..... 214/16.1 R, 16.1 E, 214/16.1 ED, 16.1 EC, 16.1 C, 16.1 CC, 16.1 CE, 100; 187/8.41, 8.52, 8.59, 8.61, 8.71

[56] References Cited

UNITED STATES PATENTS

| | | | |
|---|---|---|---|
| 2,344,246 | 3/1944 | Grubich | 214/100 |
| 2,765,932 | 10/1956 | Nielsen | 214/16.1 CE |
| 2,858,032 | 10/1958 | Morley | 214/16.1 ED |

FOREIGN PATENTS OR APPLICATIONS

| | | | |
|---|---|---|---|
| 437,741 | 11/1967 | Switzerland | 214/16.1 R |
| 1,208,787 | 10/1970 | United Kingdom | 187/8.41 |
| 1,149,609 | 4/1969 | United Kingdom | 214/16.1 R |
| 903,307 | 8/1962 | United Kingdom | 214/16.1 ED |

*Primary Examiner*—Albert J. Makay
*Assistant Examiner*—R. B. Johnson
*Attorney, Agent, or Firm*—Woodhams, Blanchard and Flynn

[57] ABSTRACT

A two-storied parking apparatus for automobiles, including a pair of arcuate guide rails having lower ends fixed on the ground and upper ends fixed to the associating upper end portions of a pair of vertical frames which are fixed on the ground at an appropriate space from each other. A pair of movable supporting members are pivoted on the ground near the lower ends of the guide rails. An upper pallet is pivoted at the top ends of the supporting members. The upper pallet also has rollers which travel along the guide rails. A drive unit is connected to the upper pallet so that it can be moved up and down while maintaining a horizontal position due to the rollers travelling along the guide rails.

6 Claims, 9 Drawing Figures

Fig. 2-A

TWO-STORIED PARKING APPARATUS FOR AUTOMOBILES

FIELD OF THE INVENTION

This invention relates to a parking apparatus suitable for storing automobiles, especially, large-sized motor trucks or buses in upper and lower positions.

BACKGROUND OF THE INVENTION

Various simple parking facilities of two or more storied types have been proposed heretofore. These known facilities, however, are primarily adapted to park small- or medium-sized automobiles. Because of its heavy weight and large dimensions, no such facilities has been developed yet in a simple construction for parking large-sized automobiles.

In recent years, bus terminals at various tourist resorts and truck terminals are overcrowded with large-sized buses and trucks and difficulties are often encountered in parking and/or marshalling them in the limited parking areas.

In view of these circumstances, this invention proposes an improved two-storied parking apparatus which has a much simplified mechanical construction, which permits an economical usage of parking space, and which can be operated in a simplified manner to park, especially, large-sized automobiles.

BRIEF DESCRIPTION OF THE DRAWINGS

FIG. 2A is a fragmentary side elevational view similar to FIG. 2 but showing a variation of the invention.

DETAILED DESCRIPTION

Figure 1:
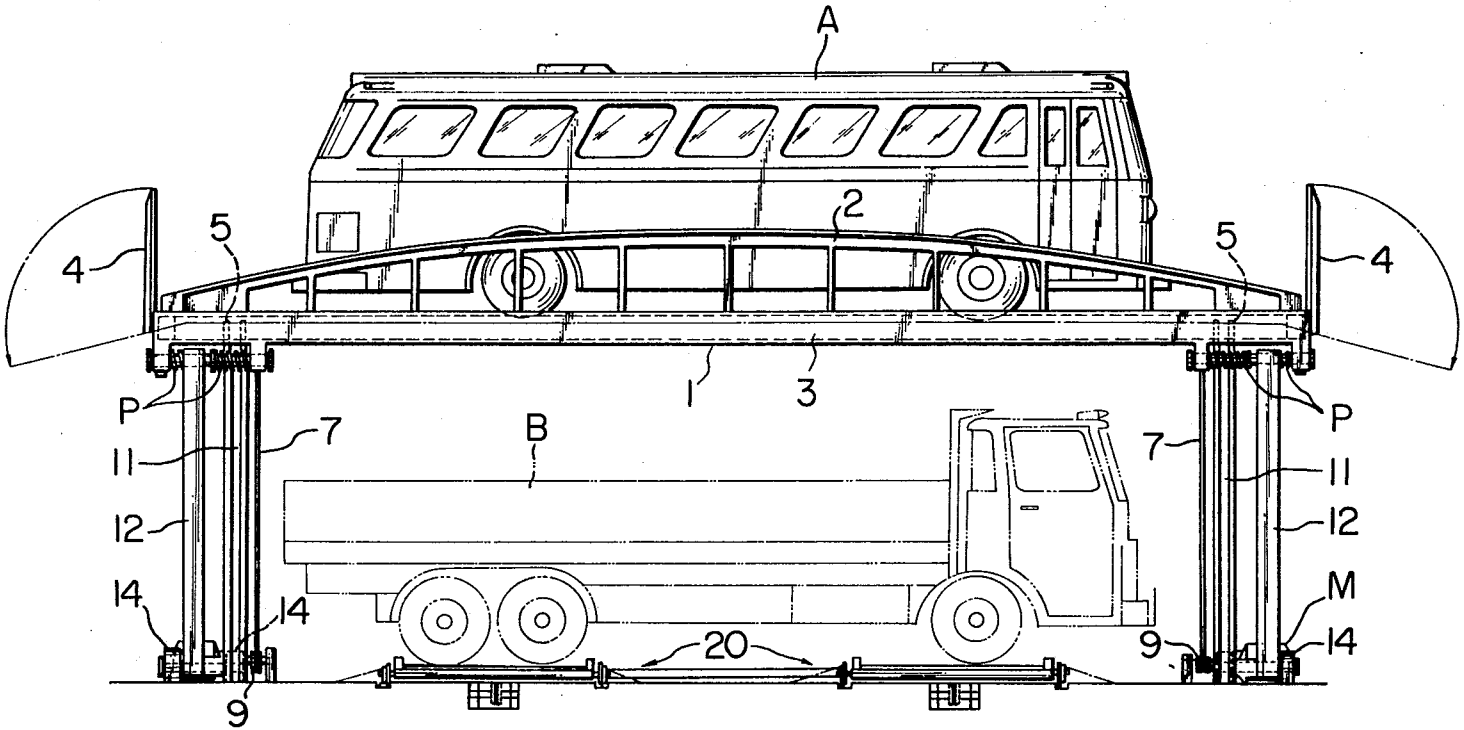
FIG. 1 is a front elevational view of the parking apparatus of this invention.

In the drawings, 1 is an upper pallet. On and along the main beams 3 of said upper pallet 1, a pair of guard members 2, 2 are arranged. As illustrated in FIG. 1, 3, 4, main beams 3, 3 extend along opposite side edges of the upper pallet 1. At the longitudinal opposite ends of the upper pallet 1 are pivoted ramps 4, 4 swingable up and down (FIG. 1). A pair of rollers 5, 5 are rotatably supported on the end of each end beams 3′ of the upper pallet 1 (FIG. 2), and their axes are elastically held by means of buffer springs 6, 6. A pair of ropes 7, 7 are attached at their one end to said upper pallet 1 on the side edge thereof where the rollers 5, 5 are arranged. The ropes 7, 7 are extended over pulleys 8, 8 so that they can be wound onto and rewound from drums 9, 9 which are driven by an electric motor M installed on the ground.

A pair of main supporting poles 10, 10 are fixed to the ground in a vertical position. On the top end of these crooked main poles 10, 10 are supported horizontal shafts S adapted to carry said pulleys 8, 8 in a rotatable manner. The upper ends of a pair of arcuate guide rails 11, 11 are positioned slightly below said pulleys 8, 8 and the lower ends of these guide rails 11, 11 are fixedly supported on the ground. In the shown embodiment, the guide rails 11, 11 have an inverted T-shaped cross section so that the rollers 5, 5 arranged on the bottom of said upper pallet 1 can be rotatingly guided along said guide rails holding these guide rails between flanges of said rollers.

A pair of movable supporting members 12, 12 are pivotally attached to the end beams 3′, 3′ at their other ends by the pivot axes 13, 13. The lower ends of said supporting members 12, 12 are pivoted on axes 15, 15 which are held in bearings 14, 14 rigidly mounted on the ground.

The upper bearing portions of said supporting members 12, 12 are pivoted under the upper pallet 1 by way of torsion springs P (see FIG. 1) so as to buffer or compensate for the deflection of the upper pallet 1 which might be encountered by loading a heavy automobile on the upper pallet 1.

Figure 2:
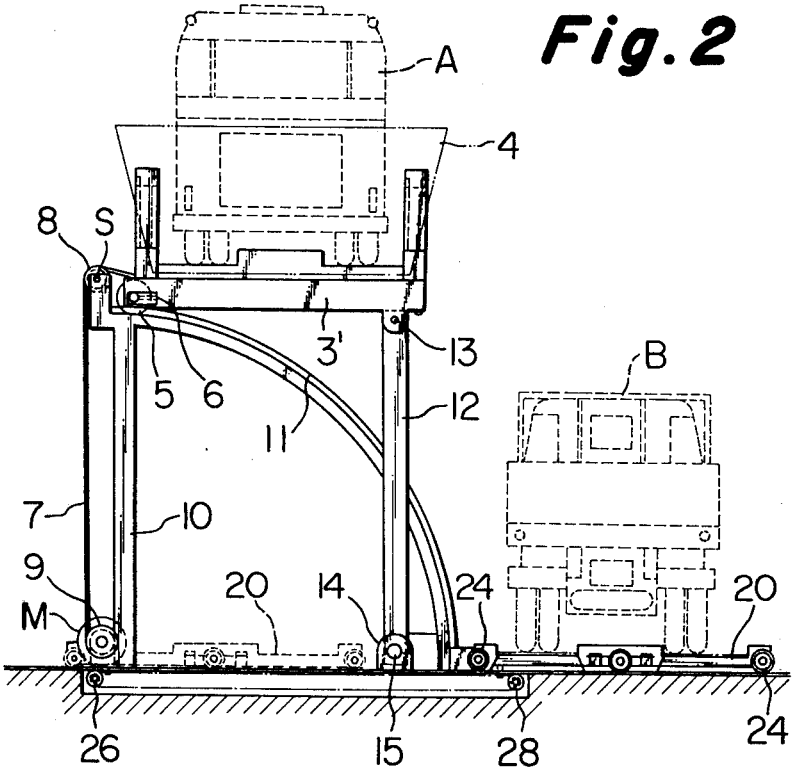
FIG. 2 is a side elevational view of the apparatus seen from the left as viewed in FIG. 1, the apparatus being illustrated in the position where an automobile is about to be positioned on (or dispatched from) the lower pallet.
Figure 2:
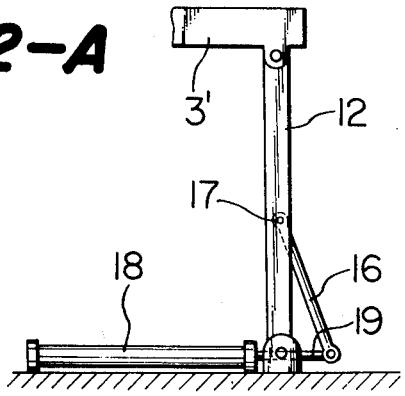

FIG. 2-A shows an embodiment wherein support arms 16, 16 are pivoted on the associated supporting member 12, 12 at almost center positions thereof by the journal axes 17, 17. The opposite ends of these support arms 16, 16 are pivotably connected to rams 19, 19 of air cylinders 18, 18 fixedly mounted on the ground in a horizontal position. The air cylinders 18, 18 are operative in synchronism with the operation of the motor M and the stroke of the rams 19, 19 is suitably controlled in association with the winding and rewinding of the ropes 7, 7, so that the supporting members 12, 12 can be swung up and down smoothly.

Figure 6:
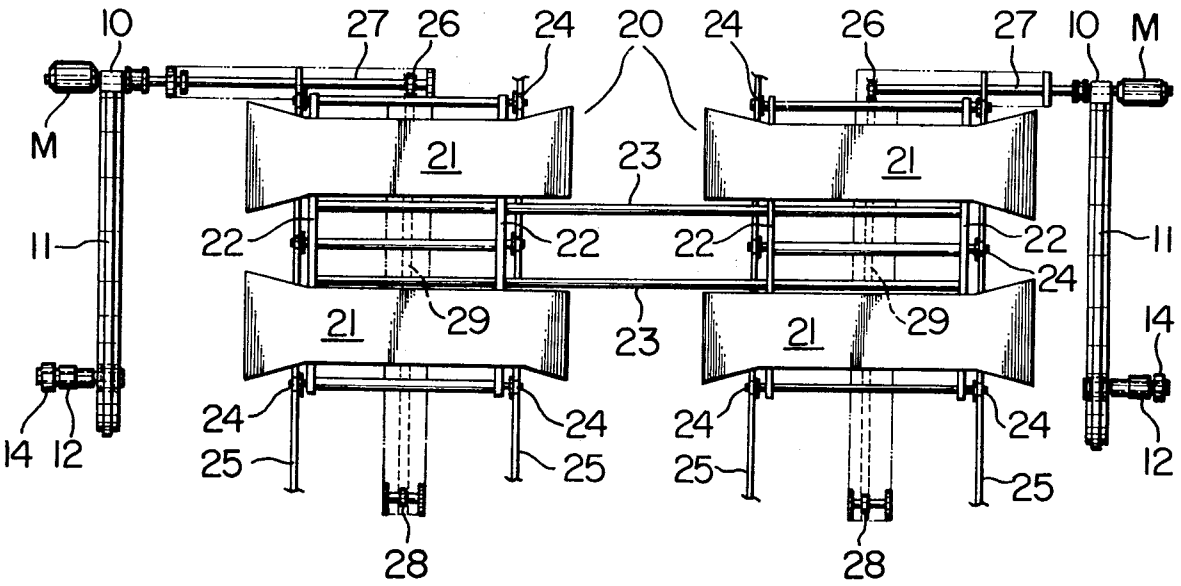
FIG. 6 is a plan view of the lower pallet.

FIG. 6 generally illustrates a lower pallet 20, which includes four separate boards 21 adapted to support the front and rear wheels of an automobile. The front and rear wheel supporting boards 21, 21 are fixedly mounted on the frames 22, 22, which are integral with the horizontal beams 23.

The said front and rear frames 22, 22 supported on the wheels 24, 24, which travel on the rails 25, 25, fixedly laid on the ground. A sprocket 26 is fixedly mounted on a horizontal drive shaft 27 within an underground pit shown by a chain line. Said drive shaft 27 is driven by an electric motor M by way of a clutch. Another sprocket 28 is arranged in the pit in front of the sprocket 26 (in the lower position as viewed in FIG. 6). The first and second sprockets 26 and 28 are operatively connected by means of a chain 29 which is driven within the pit in a horizontal position. The upper reach of said chain 29 is connected to the beam 23 of the lower pallet 20 at a lower position of said beam 23 by some suitable means, so that the lower pallet 20 can be displaced by driving said chain 29.

Figure 3:
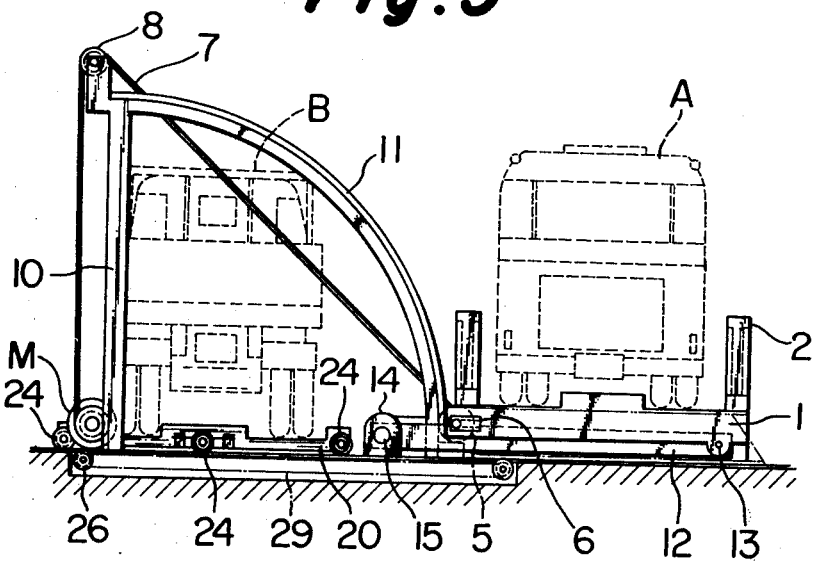
FIG. 3 is a view similar to FIG. 2, but illustrating an automobile in a position where it is about to be positioned on (or dispatched from) the upper pallet.
Figure 4:
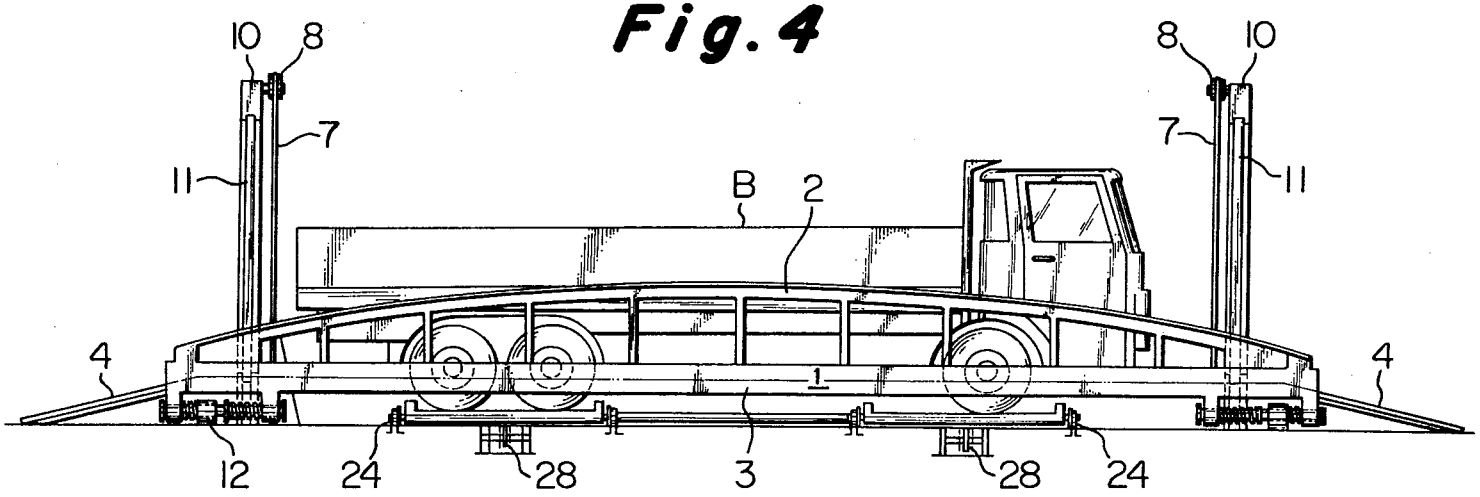
FIG. 4 is a side elevational view of the apparatus seen from the right as viewed in FIG. 3.
Figure 5:
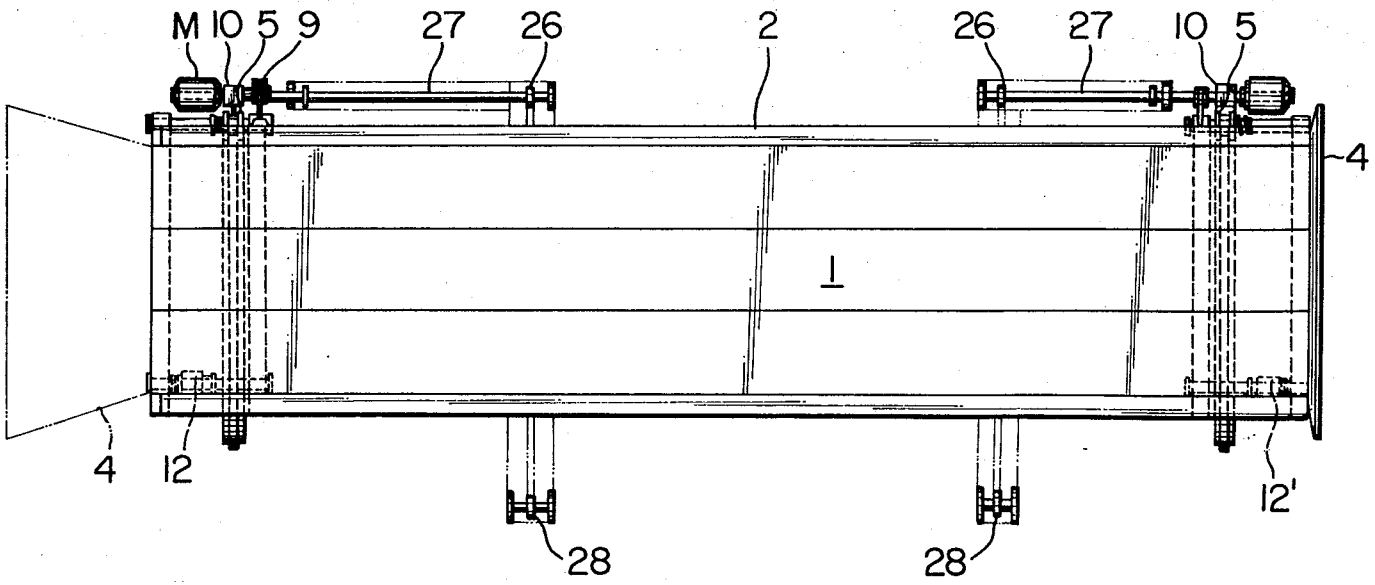
FIG. 5 is a plan view of the upper pallet.

With the foregoing operation, the parking apparatus of this invention operates in such a manner as described hereinunder with reference to FIGS. 2, 3 and 4.

In case when an automobile A which is on the elevated upper pallet 1 is to be lowered for permitting same to be dispatched from the pallet, first of all the electric motor M is driven to unwind the ropes 7 from the drums 9. Under these conditions, because of its own weight the upper pallet 1 lowers along the inclined surfaces of the rails 11, 11 as the rollers 5, 5 run keeping on the said inclined surfaces. Consequently, the supporting members 12, 12, each pivoted at 13 and 15, are swung down rightwardly (as viewed in FIG. 2) about the axes 15, 15. When the ropes 7 are extended to the full extent, the upper pallet 1 is positioned on the ground as shown in FIGS. 3 and 4. So long as the curve of said guide rails 11, 11 is selected so as to be in conformity with the locus of the moving axes 13, 13, the upper pallet 1 can be lowered while maintaining a horizontal position.

Under conditions when the upper pallet 1 is on the ground, the ramps 4 can be swung down to permit the automobile to be driven down from the upper pallet 1.

According to the embodiment of FIG. 2-A, the air cylinders 18 are operative in association with said electric motor M and the stroke of the rams 19 is selected depending on the extension of the ropes 7, so that the supporting members 12 can be swung down under control of the associated support arms 16. Thus the upper pallet can be lowered smoothly in a stabilized manner and the load applied onto the ropes 7 can be reduced.

The upper pallet 1, which is carrying an automobile when in its lowered position as shown in FIG. 3, can be elevated to the upper position shown in FIG. 2 by repeating the aforementioned operations in the reverse order.

The parking apparatus is preferably provided with a lower pallet 20, whereby a further automobile B can be parked thereon as described hereinunder with reference to FIGS. 2, 3 and 6.

When the drive shaft 27 is rotated by starting the electric motor M and by engaging the clutch, the lower pallet 20 will be displaced along the rails 25 by means of chains 29 running over sprockets 26 and 28. When the lower pallet 20 has been pulled to the position shown in FIG. 2, then the automobile B is readily to be discharged.

By repeating the aforementioned operations in the reverse order, an automobile which has been driven onto the forwardly pulled lower pallet 20 may be displaced to the storage position just below the upper storage position (showed by dotted line).

It will be appreciated from the foregoing description that the present invention provides a very simple construction which permits storing large automobiles in upper and lower positions. The upper pallet 1 can be elevated and lowered while being supported and guided by rollers and supporting members which are pivoted at their upper and lower ends. This means that the upper pallet 1 can be operated smoothly in a reliable manner. Besides, the upper pallet 1 is supported at four different points and elevating and lowering forces are applied to the upper pallet 1 at these four points. Supporting the upper pallet 1 on the arcuate surface of the guide rails also provides a desirable operation. Because of the above mentioned features relating to the structure of this invention, driving power to move the upper pallet is smaller than the power necessary to move the upper pallet in a straight vertical direction as in a conventional mode. In addition, the upper pallet can be made light weight compared with that of a cantilevered support. Large automobiles can be parked and dispatched with simple operations and the spaces required for storing and marshalling the automobiles can be reduced extremely as described later.

Figure 7:
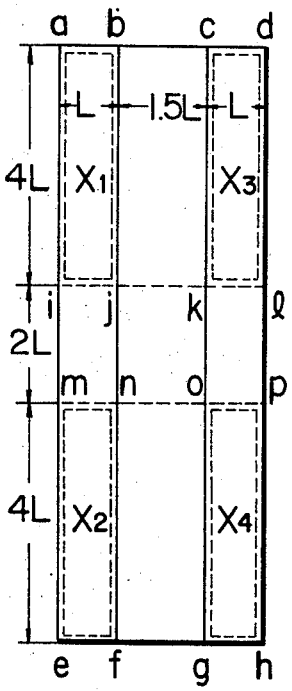
Fig. 7 PRIOR ART
FIGS. 7 and 8 are views for explaining the parking area required in the parking system of this invention in comparison with that required in a conventional plane parking system.
Figure 8:
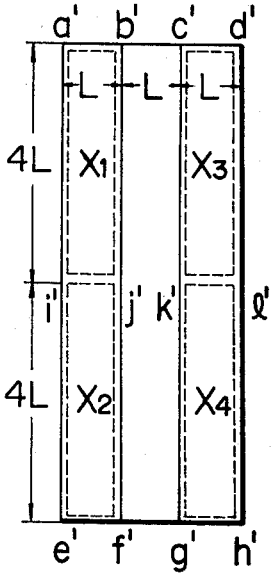

FIGS. 7 and 8 are views for explaining the difference between the parking areas required in this invention and in a conventional plane parking system. Of these drawings, FIG. 7 shows a conventional plane parking system and FIG. 8 shows the parking system adopted by the parking apparatus of this invention which is provided with a lower pallet.

Suppose that the width of an ordinary large-sized bus is represented by L (unit length), then it has usually a length of 4L. FIG. 7 shows a typical example wherein four large-sized buses X1, X2, X3 and X4 (shown by dotted lines) are parked in a rectangular parking areas *a e h d.* In this example, for the purpose of marshalling the buses the intermediate passages *b, f, g* and *c* need to have a width corresponding to 1.5, or a width 1.5L times as large as the width of these buses. It is also required to leave spaces *i, m, p* and l having a length corresponding to at least 2L, or a length at least a half of the bus length, in front and in the rear of each bus (in the drawing, figures represent the dimensions expressed by the unit as defined hereinabove).

In this system, therefore, the total necessary parking area corresponds to the product of the total width multiplied by the total length, or $35L^2$.

According to this invention, as shown in FIG. 8, when there is provided no sidewardly displaceable lower pallet in the lower parking position, it is necessary to provide passages similar to those as required in the plane parking system. Thus, according to this parking system 8 buses in total, or two times as many buses can be parked within the area equal to that required by said plane parking system for parking 4 separate buses.

According to this invention when using a lower pallet, the bus can be placed on the lower pallet simply by driving it straight ahead into the center passage and then the bus can be sidewardly displaced to the position just below the upper pallet simply by shifting the lower pallet sidewards. Also the bus can be placed on the upper pallet simply by driving it straight ahead into the center passage. Accordingly, the rectangular area *a'e'h'd'* (which will be 24L as expressed by said unit L) will be wide enough to park 8 large-sized buses. In other words, this parking system needs a ground area of only $24/35 \times 1/2$ of FIG. 7 of that required in the conventional plane parking system of FIG. 7. This means that the parking system of this invention is able to accommodate about 2.9 times as many large automobiles as the conventional plane parking system within an equal ground area.

Although the parking apparatus of this invention is most suitably applicable to accommodate especially large-sized automobiles, it will readily be appreciated that the apparatus can be utilized conveniently also as a simpe parking apparatus for small- and medium-sized automobiles.

I claim:

1. An elevated parking apparatus for automobiles, comprising:

a pair of frames stationarily fixed to and projecting upwardly from the ground, said frames being spaced from one another;

said pair of frames defining a pair of substantially parallel, arcuate guide rails fixedly associated with the respective frames, each said guide rail defining thereon an arcuate guide surface disposed substantially within a vertical plane, one end of said guide surface being disposed closely adjacent the ground, the other end of said guide surface being spaced vertically upwardly a substantial distance above the ground and horizontally offset with respect to said one end;

pulley means rotatably supported on each of said frames adjacent the upper end of the respective arcuate guide rail;

an upper pallet adapted to have a vehicle positioned and supported thereon, said pallet extending between said frames and having a pair of roller means mounted thereon and disposed in rolling engagement with said pair of guide rails, whereby said roller means rollingly engage said arcuate guide surfaces, said roller means being rotatably supported on said pallet adjacent one edge thereof;

a pair of elongated support members having the lower ends thereof pivotally connected to and supported adjacent the ground so that said support members are swingably movable within vertical planes which are substantially parallel to the vertical planes defined by said arcuate guide surfaces, each of said support members being positioned in the vicinity of one of said frames, said support members having the upper ends thereof pivotally connected to said pallet at a location thereon spaced sidewardly from said roller means, said location being disposed more closely adjacent the opposite edge of said pallet, said frames and said supporting members maintaining said pallet in a substantially horizontal orientation at all times;

drive means for moving said pallet between a lowered position wherein the pallet is disposed adjacent the ground for permitting a vehicle to be positioned on or removed from the pallet and an elevated position wherein the pallet is disposed vertically upwardly a substantial distance above said ground, said drive means including a drive motor stationarily mounted with respect to said frame and positioned adjacent the ground, and a pair of elongated flexible cables having the lower ends thereof connected to said drive motor, said cables passing upwardly from said drive motor and over said pulley means so that the other ends of said cables are connected to said pallet;

auxiliary force means coacting directly with said support members to assist in controlling the swinging movement of said support members when said pallet is being raised or lowered, said auxiliary force means including fluid pressure cylinder means interconnected to said support members for controlling the swinging movement thereof; and said pallet when in said elevated position having the weight thereof supported solely by said frames and said pair of elongated support members, said pallet when being moved between said elevated and lowered positions being constrained for movement along a preselected path due to said roller means being disposed in rolling engagement with said arcuate guide surfaces simultaneous with the vertical swinging movement of said support members between a position wherein they extend substantially vertically upwardly when the platform is in said elevated position and a position wherein they project substantially horizontally and are disposed closely adjacent the ground when the platform is in said lowered position.

2. An apparatus according to claim 1, wherein each of said frames includes an upright post having the lower end connected to the ground and projecting upwardly therefrom in a vertical direction, said arcuate guide rail extending through approximately a quarter circle, the upper end of said arcuate guide rail being fixedly secured to said vertical post adjacent the upper end thereof, said support members having the lower ends thereof pivotally supported on the ground at a location closely adjacent the lower end of said guide rail.

3. An elevated parking apparatus for automobiles, comprising:

a pair of frames stationarily fixed to and projecting upwardly from the ground, said frames being spaced from one another;

said pair of frames defining a pair of substantially parallel, arcuate guide rails fixedly associated with the respective frames, each said guide rail defining thereon an arcuate guide surface disposed substantially within a vertical plane, one end of said guide surface being disposed closely adjacent the ground, the other end of said guide surface being spaced vertically upwardly a substantial distance above the ground and horizontally offset with respect to said one end;

an upper pallet adapted to have a vehicle positioned and supported thereon, said pallet extending between said frames and having a pair of roller means mounted thereon and disposed in rolling engagement with said pair of guide rails, whereby said roller means rollingly engage said arcuate guide surfaces, said roller means being rotatably supported on said pallet adjacent one edge thereof;

a pair of elongated support members having the lower ends thereof pivotally connected to and supported adjacent the ground so that said support members are swingably movable within vertical planes which are substantially parallel to the vertical planes defined by said arcuate guide surfaces, each of said support members being positioned in the vicinity of one of said frames, said support members having the upper ends thereof pivotally connected to said pallet at a location thereon spaced sidewardly from said roller means, said location being disposed more closely adjacent the opposite edge of said pallet, said frames and said supporting members maintaining said pallet in a substantially horizontal orientation at all times;

drive means for moving said pallet between a lowered position wherein the pallet is disposed adjacent the ground for permitting a vehicle to be positioned on or removed from the pallet and an elevated position wherein the pallet is disposed vertically upwardly a substantial distance above said ground, said pallet when in said elevated position having the weight thereof supported solely by said frames and said pair of elongated support members, said pallet when being moved between said elevated and lowered positions being constrained for movement along a preselected path due to said roller means being disposed in rolling engagement with said arcuate guide surfaces simultaneous with the vertical swinging movement of said support members between a position wherein they extend substantially vertically upwardly when the platform is in said elevated position and a position wherein they project substantially horizontally and are disposed closely adjacent the ground when the platform is in said lowered position; and a lower pallet adapted to have a vehicle positioned and supported thereon, and a drive unit interconnected to said lower pallet for movably displacing said lower pallet horizontally between (1) a first position wherein the lower pallet is disposed between the frames and is positioned substantially directly beneath the upper pallet when it is in its elevated position and (2) a second position wherein it is displaced sidewardly from said first position and is displaced outwardly from between said frames for enabling a vehicle to be positioned on or removed from said lower pallet, said lower pallet being positioned closely adjacent the ground when in both said first and second positions whereby said first and second positions are horizontally sidewardly displaced from one another but are at substantially the same elevation.

4. An apparatus according to claim 3, wherein said drive means includes a drive motor stationarily mounted with respect to the ground, and an elongated flexible force-transmitting element connected between said motor and said upper pallet to effect raising or lowering of said upper pallet along said arcuate guide surfaces.

5. An apparatus according to claim 3, wherein each of said frames has pulley means rotatably supported thereon adjacent the upper end of the respective arcuate guide rail, said drive means including a drive motor stationarily mounted with respect to said frame and positioned adjacent the ground, and a pair of elongated flexible cables having the lower ends thereof connected to said drive motor, said cables passing upwardly from said drive motor and over said pulley means so that the other ends of said cable are connected to said upper pallet.

6. An apparatus according to claim 5, including auxiliary force means coacting directly with said support members to assist in controlling the swinging movement of said support members when said upper pallet is being raised or lowered, said auxiliary force means including fluid pressure cylinder means interconnected to said support members for controlling the swinging movement thereof.

* * * * *